US006863461B2

(12) United States Patent
Werner

(10) Patent No.: US 6,863,461 B2
(45) Date of Patent: Mar. 8, 2005

(54) BULLDOZER BLADE PITCH ADJUSTER

(75) Inventor: Ronald H. Werner, Burlington, IA (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 10/462,940

(22) Filed: Jun. 17, 2003

(65) Prior Publication Data

US 2005/0000709 A1 Jan. 6, 2005

(51) Int. Cl.[7] ..... F16G 11/12
(52) U.S. Cl. ..... 403/43; 403/46
(58) Field of Search ..... 403/43, 46, 78, 403/60; 172/824, 818

(56) References Cited

U.S. PATENT DOCUMENTS 4,828,045 A * 5/1989 Horsch et al. ..... 172/821
5,507,352 A * 4/1996 Frisbee et al. ..... 172/818
5,702,196 A * 12/1997 Petercsak ..... 403/46
5,924,496 A * 7/1999 Buchanan et al. ..... 172/824
6,247,540 B1 6/2001 Clemen et al.

* cited by examiner

*Primary Examiner*—John R. Cottingham
(74) *Attorney, Agent, or Firm*—Collin A. Webb; John William Stader

(57) ABSTRACT

A bulldozer blade pitch adjuster is disclosed having an adjustable length member with a body and two threaded members threaded into opposing ends of the body, and a cover that can be attached to the body to cover the body and the two threaded members, that can be removed from the body and engaged with the body in a second adjusting position where the cover acts as a wrench to rotate the body, thereby changing the length of the adjustable length member. Once the member is adjusted, the cover can be secured to the body in its first covering position.

11 Claims, 4 Drawing Sheets

BULLDOZER BLADE PITCH ADJUSTER

FIELD OF THE INVENTION

The invention relates generally to bulldozer adjusting devices. More particularly, it relates to bulldozer blades and pitch adjusting devices for adjusting blade pitch having integral covers or shields.

BACKGROUND OF THE INVENTION

Bulldozers and other bladed vehicles have many adjustments that are necessary to maintain the blade in the proper orientation for grading or digging the ground. Some of these adjustments may be easily carried out using readily available hand tools that are kept with the operator or on the vehicle. Some of them use specialized tools that are often misplaced or forgotten after the adjustments are performed.

One of the common features to adjust on a bladed vehicle is the pitch of the blade. The pitch of a dozer blade controls the angle the blade is at with respect to the ground when viewing the blade from the side. If the pitch is changed by tilting the top of the blade-away from the cab of the vehicle, the blade engages the ground at a sharper angle and cuts more deeply into the ground. If the pitch is changed to tilt the top of the blade toward the cab of the vehicle, the blade engages the ground at a shallower angle and tends to scrape the ground more than dig down into it. When pitched back, this position is known as the carry position, which allows the blade to carry a larger load.

The blade pitch is changed relatively frequently when using a bulldozer or other bladed vehicle. The pitch controls the aggressiveness of cut, and the ability to control the aggressiveness of cut often changes as the vehicle moves from one portion of a work site to another portion. Furthermore, the pitch of the blade may be preferably changed when the texture, composition or moisture content of the soil changes. It should be clear that any of a variety of factors can make it desirable to change the pitch of the blade to better grade or scrape the soil.

Most bulldozers and bladed vehicles are provided with adjustment devices to adjust the pitch of their blades. These adjustment devices typically include a link whose length is adjustable to change the blade pitch. These links, however are typically not adjustable by hand, but are configured to require an external tool to change their length or otherwise adjust them. These tools may be misplaced, left on the vehicle, fall off and disappear when the pitch is adjusted.

What is needed therefore is a system for adjusting the pitch of a blade that reduces the possibility that the adjusting tool will be lost. What is also needed is a blade adjustment tool that can be quickly and easily used to reduce the downtime necessary to adjust the blade. What is further needed is a way of storing the adjusting tool that reduces the need for additional storage on the vehicle. What is also needed is an adjusting tool that will serve to reduce the costs of the vehicle by combining the functions of a pitch cover guard and an adjusting tool. It is an object of this invention to provide one or more of these benefits and advantages in one or more of the embodiments described below.

SUMMARY OF THE INVENTION

In accordance with a first embodiment of the invention, a bulldozer blade pitch adjuster is provided including a turnbuckle having first and second turnbuckle eyes, a turnbuckle body joining the turnbuckle eyes, and an elongate member configured to be removably fixed to the turnbuckle in a first stowed position and to engage the turnbuckle for adjustment in a second adjusting position. The elongate member may be configured to cover substantially all the turnbuckle body in the first stowed position. It may also be configured to cover exposed threads of the two turnbuckle eyes when it is in the stowed position. The elongate member may cover a top surface and two opposing sides of the turnbuckle body and the turnbuckle eyes to protect the turnbuckle from side injury as well. The turnbuckle body may have a first pair of opposed wrenching flats spaced a first distance apart and formed on the turnbuckle body's outer surface to engage the elongate member. There may be two or more pairs of these opposed wrenching flats that are spaced angularly around the longitudinal axis of the turnbuckle to provide multiple sets of engagement surfaces for the elongated member. The elongated member may be formed as an elongated U-channel channel formed of two elongate and parallel sidewalls and an elongated central bridging region extending between and coupling the two sidewalls. The central region may be cut away at one end to leave two parallel and facing longitudinal portions of the two sidewalls. The facing longitudinal portions may be spaced to define a gap therebetween equal to the first distance.

DETAILED DESCRIPTION OF THE PREFERRED EMBODIMENTS

Figure 1:
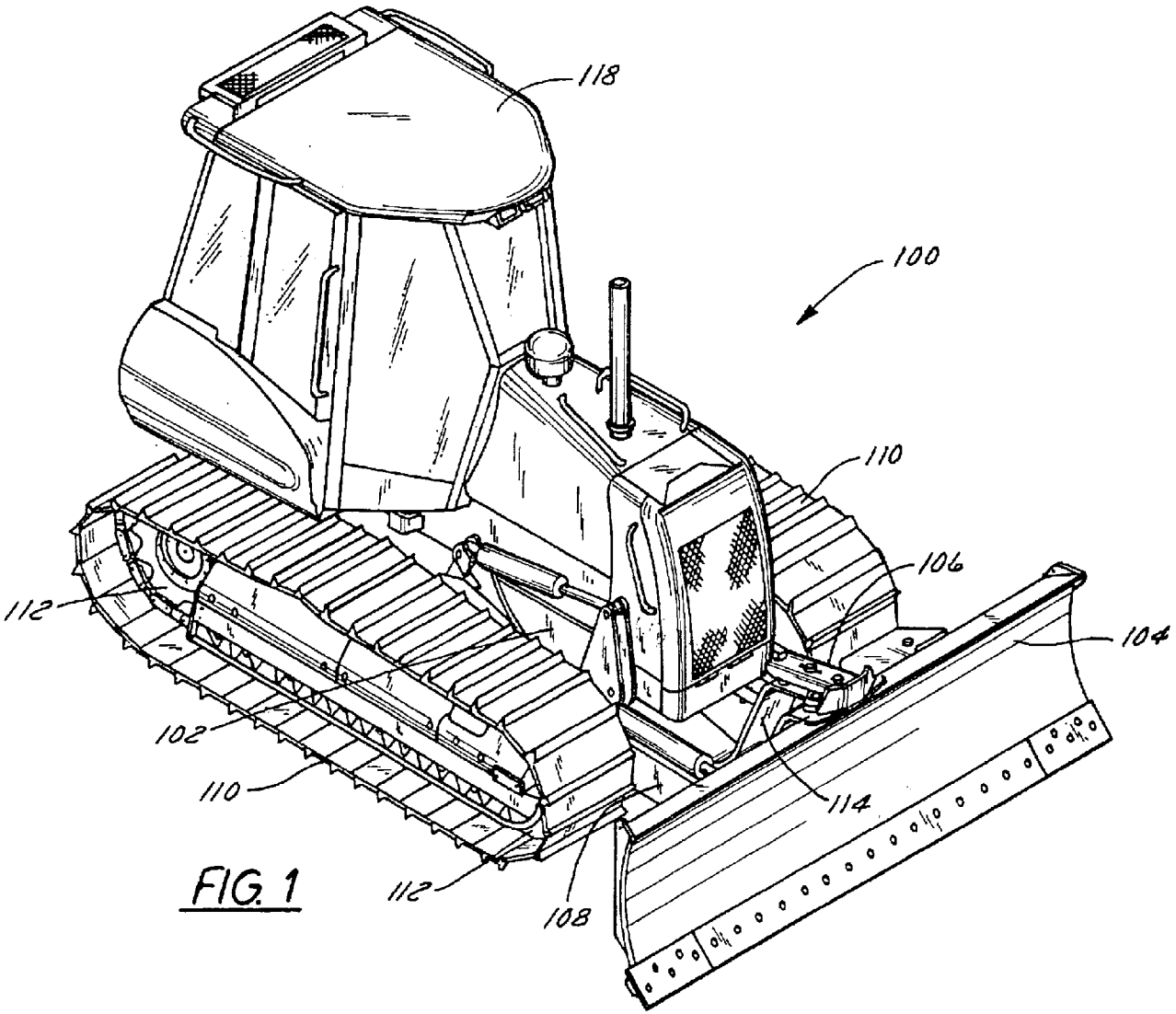
FIG. 1 is a perspective view of a bulldozer having a blade pitch adjuster in accordance with the present invention.

Referring to FIG. 1, a bladed vehicle 100 has a chassis 102, a blade 104 coupled to the c-frame 108, which is coupled to the chassis, and a blade pitch adjuster 106 that is coupled to the blade to adjust its pitch.

Vehicle 100 is shown here as a bulldozer. It has a pair of forwardly extending arms of c-frame 108 disposed on either side of the vehicle to which blade 104 is coupled. The vehicle is supported on two endless tracks 110 that wrap around wheels 112 that extend laterally outward from opposite sides of the vehicle. The two arms are coupled together at their forward ends to provide a blade carrier 114 that has a plurality of mounts 116 (FIG. 2) for supporting and positioning the blade.

An operator's compartment 118 is disposed in the center of the vehicle in which the operator and operator controls are located. Compartment 118 extends slightly outward on either side of the vehicle to overlap the tracks that support the vehicle.

Figure 2:
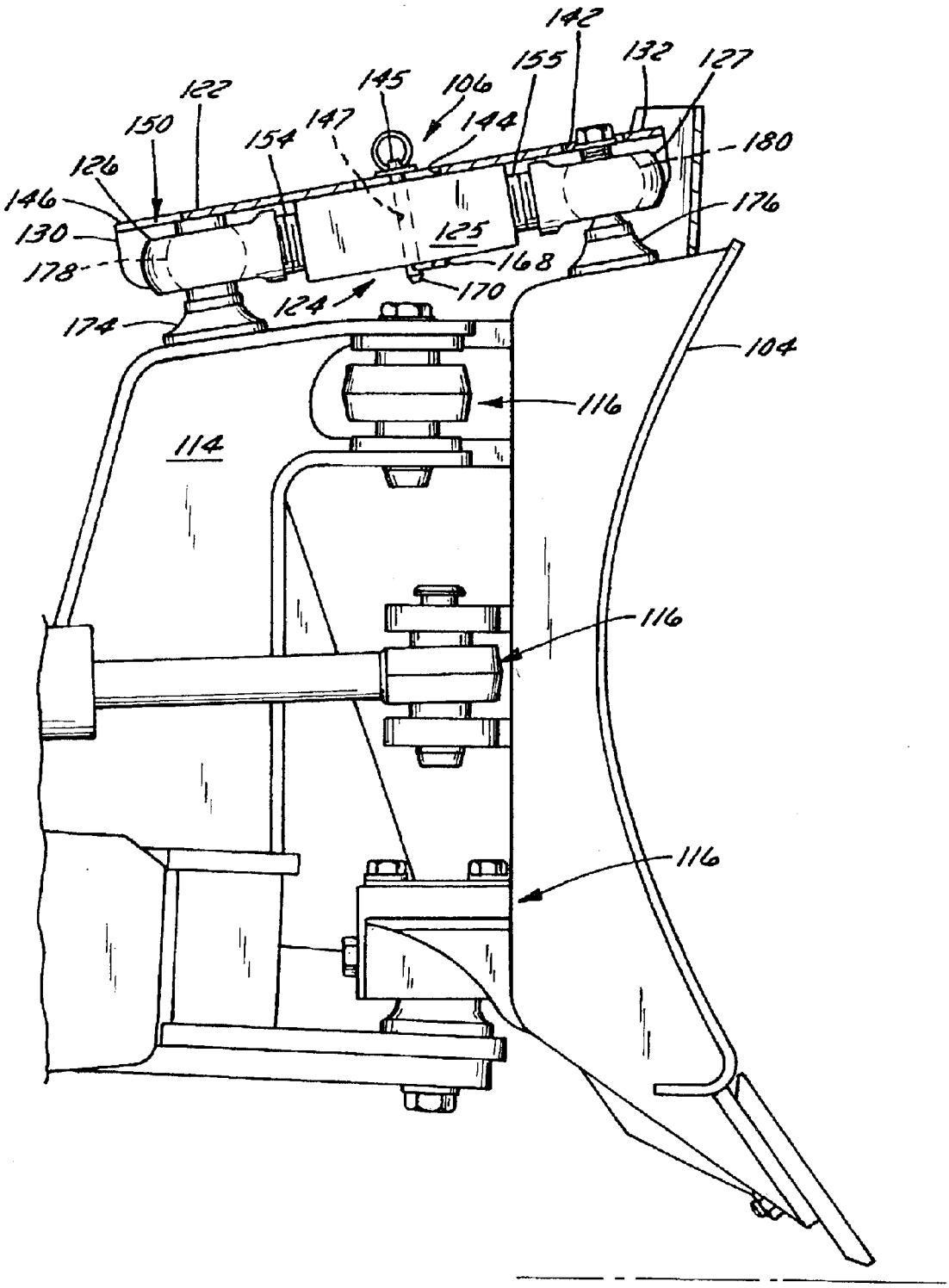
FIG. 2 is an exploded perspective view of the blade pitch adjuster of FIG. 1.

In FIG. 2, blade pitch adjuster 106 is disposed between and coupled to the blade carrier 114 and the blade 104. This adjuster includes a cover 122 that extends over and protects the adjuster's turnbuckle 124. The blade is pitched by rotating the turnbuckle body 125 either clockwise or counterclockwise to extend the threaded eyes 126, 127 from the body or retract the threaded eyes into the body.

Figure 3:
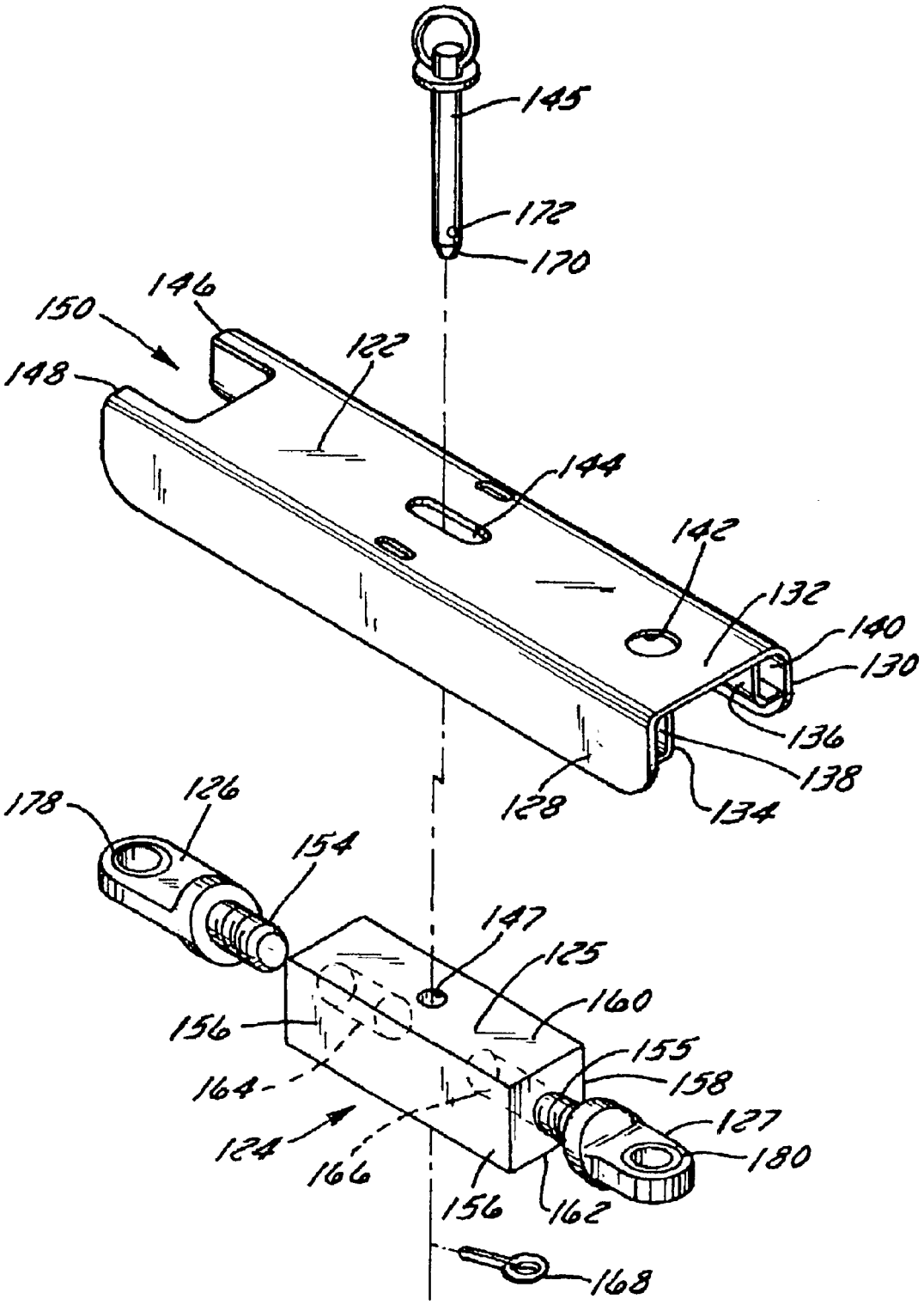
FIG. 3 is a partial cross-sectional side view of the bulldozer chassis, the bulldozer blade and the blade pitch adjuster in a first stowed position.

Referring now to FIG. 3, a detailed exploded view of the pitch adjuster can be seen. Cover 122 is comprised of two elongated lateral side walls 128 and 130 that extend generally parallel to one another and are coupled together by an elongated central bridging portion 132 of the cover 122. The central bridging portion 132 is coupled to the side walls 128, 130. Portion 132 together with the two side walls 128, 130 define the generally U-shaped structure of cover 122.

Each side wall 128, 130 of cover 122 also includes an elongated L-shaped channel 134, 136, respectively. These channels 134, 136 are fixed (typically welded) to and between the side walls 128, 130 and the central bridging portion 132 to define rectangular hollows 138, 140, extending the length of the cover 122.

There are several apertures in cover 122, including an aperture 142 This is provided to lock the cover from moving for and aft. That is why the bolt extends up out of the cover. The long slot is required as the turnbuckle is adjusted in and out since the hole in the center block is fixed, but the distance to the front pin is changing which the cover is locked over. Greasing of these turnbuckles is from the side of items 126 and 127. Items 127 and 180 are purchased as an assembly and slide down over item 176.

A second aperture 144 is also provided in cover 122 to connect the cover 122 to the turnbuckle 124, and more particularly the turnbuckle body 125. The aperture 144 is elongated to accommodate changes in the length of the adjuster 106. Aperture 142 surrounds a fitting that extends from the eye in end 127 of the adjuster 106. Whenever the length of the adjuster changes, the distance between the eye in ends 127 and the middle of aperture 147 changes. A retaining pin 145 of turnbuckle 124 is inserted through second aperture 144 and through a third aperture 147 in turnbuckle body 125. The pin is secured in turnbuckle body 125 and keeps cover 122 from coming off. Alternative configurations of the retaining pin include a threaded pin 145 that is retained by a nut, and a pin 145 that has a ball detent disposed to retain the pin within the aperture that receives it.

At one end of turnbuckle 124 are two parallel and facing longitudinally extending portions 146, 145 of the cover 122. These portions have inner surfaces that are generally parallel and define therebetween a slot 150 that is configured to receive the body 125 of turnbuckle 124.

The elongate extending portions 146, 148 include portions of both the sidewalls 128, 130 and channels 1.34, 136. Each extending portion therefore describes a boxlike structure formed of the sidewalls and the channels which are fixed (preferably welded) thereto. These boxlike structures provide additional strength to cover 122 when it is used to adjust the turnbuckle.

Turnbuckle 124 is comprised of a turnbuckle body 125 that is generally polygonal in cross section, preferably a square (as shown here) or a regular hexagon. It has a two pairs 156, 158, and 160, 162 of opposing parallel planar surfaces. These pairs of surfaces are spaced the same distance apart—a distance preferably equal to the space between the parallel facing surfaces of longitudinally extending portions 146, 148 of cover 122. This permits the cover to engage and adjust the turnbuckle's length. Each pair of planar surfaces acts as wrenching flats. The pairs are circumferentially spaced ninety degrees apart, surfaces 156 and 158 being ninety degrees from surfaces 160 and 162 about the longitudinal axis of turnbuckle 124.

The turnbuckle body 125 has two co-axial holes 164, 166 extending into each opposing end of body 125. These holes are threaded, one with a right hand thread and the other with a left hand thread, to engaged similarly threaded ends 154, 155 of turnbuckle eyes 126, 127.

A key 168 is provided to engage the end 170 of pin 145. This key, is inserted into hole 172 in pin 145 to prevent the pin from being withdrawn from the turnbuckle body 125 and cover 122 (see FIG. 2).

FIG. 2 illustrates the blade 104 of the bladed vehicle as it is coupled to blade carrier 114. Blade 104 and carrier 114 have pins 174, 176 on which spherical balls 178, 180 are inserted and secured. Eyes 126, 127 have mating spherical cavities into which the spherical balls are disposed. This arrangement permits significant positional variation of pins 174, 176 with respect to eyes 126, 127, respectively.

The cover 122 is shown in a first stowed position in FIG. 2, in which the turnbuckle body 125, eyes 126, 127, and pins 174, 176 are covered by cover 122. Cover 122 is mounted on turnbuckle body 125. Should turnbuckle body 125 rotate, cover 122 rotates with it. Since adjusting blade pitch requires rotating the turnbuckle body with respect to the turnbuckle eyes, the turnbuckle body must be prevented from rotating freely when the cover is attached and the operator is operating the vehicle. If it is not fixed, turnbuckle body 125 may rotate during vehicle operation and the pitch may go out of adjustment.

To prevent the turnbuckle body from inadvertently rotating with respect to the turnbuckle eyes, cover 122 of the adjuster 106 is configured to engage and be blocked from free rotation by the stationary non-rotatable structures, the preventing body 125 from rotating, since cover 122 is fixed to body 125. The structures that block cover 122 from rotating include pins 174, 176, eyes 126, 127, blade 104 and blade carrier 114. While all these devices block rotation, the first device to block rotation is the bolt that extends out of aperture 142. If turnbuckle body 125 were to rotate with cover 122 attached, cover 122 would interfere with one or all of these structures before it could freely rotate through an entire revolution. Thus all of these structures inhibit or prevent free rotation of the turnbuckle body 125 with respect to the turnbuckle eyes 126, 127.

Figure 4:
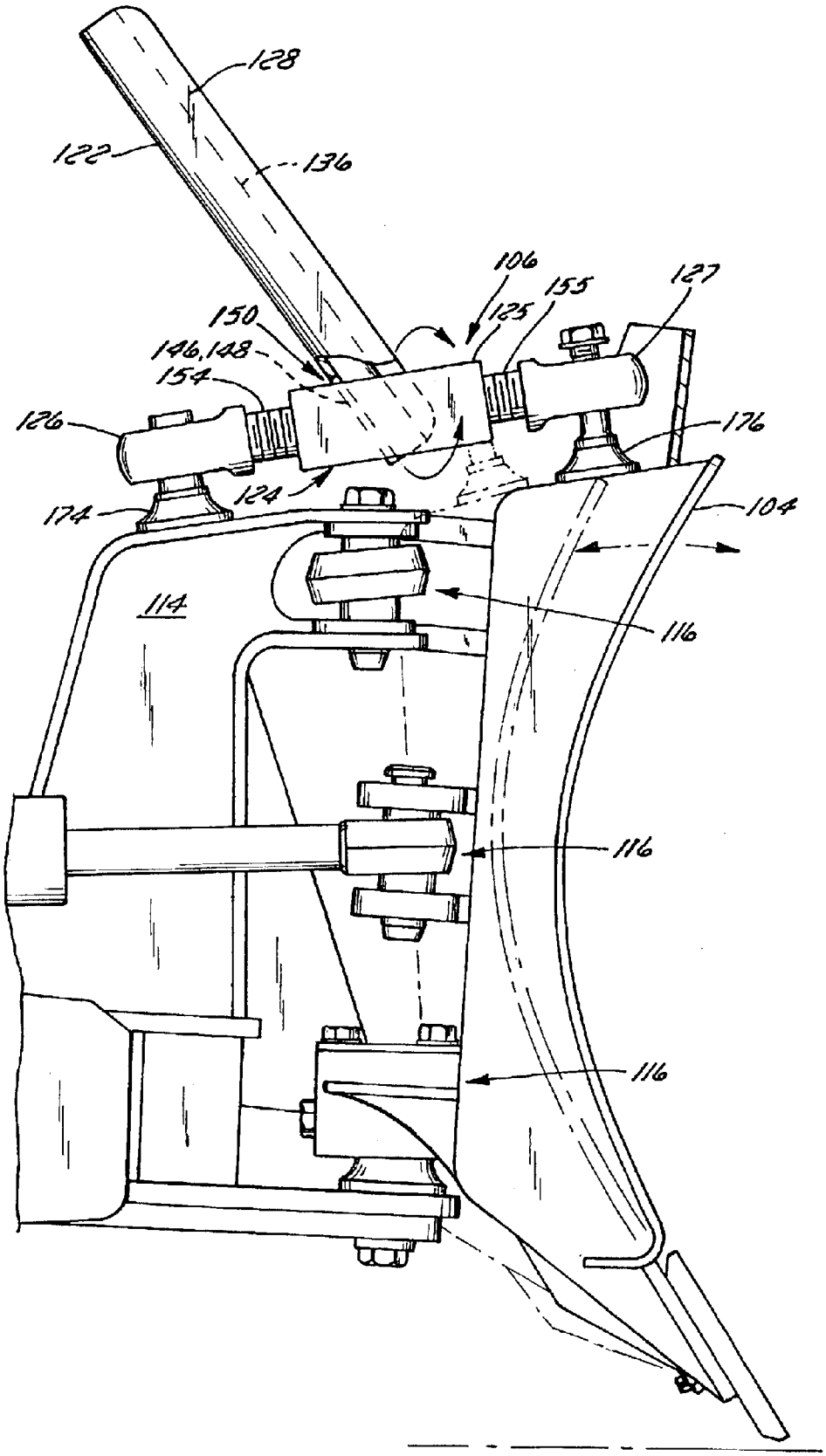
FIG. 4 is a partial cross-sectional side view of the bulldozer chassis, the bulldozer blade and the blade pitch adjuster in a second adjusting position.

FIG. 4 illustrates the blade adjuster 106 when cover 122 has been removed and is in a second adjusting position. In FIG. 4, cover 122 has been removed by withdrawing key 168 from hole 172 and pulling pin 145 from apertures 144 and 147 in cover 122 and body 125, respectively. Once removed, cover 122 is repositioned generally perpendicular to blade adjuster 106 as shown in FIG. 4.

The two longitudinally extending portions 146, 148 are oriented such that they extend one on each side of either of the pairs of surfaces 156, 158 and 160, 162 of turnbuckle body 125. In FIG. 4, portion 148 has been cutaway, to better shown body 125, but the outlines of portion 148, (which are the same as the outlines of portion 146) can be seen as dashed lines in FIG. 4. In the preferred embodiment, portions 146, 148 are spaced a distance apart such that they just surround these pairs 156, 158 and 160, 162 of parallel body surfaces and engage them just as the internal facing surfaces of a wrench engage the head of a nut or bolt. The body 125 fits into the slot or cutaway portion 150 defined between the two longitudinally extending portions.

When the cover is placed in this second, adjusting position, it can be grasped and rotated in the manner shown in FIG. 4 to rotate the turnbuckle body 125, thereby changing its length. This change in length causes the blade to tilt fore-and-aft (i.e. causing its pitch to change) with respect to pivoting blade mounts 116.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

I claim:

1. A bulldozer blade pitch adjuster, comprising:

a turnbuckle having first and second turnbuckle eyes and a turnbuckle body joining the turnbuckle eyes; and an elongated cover member configured to be removeably fixed to the turnbuckle in a first stowed position and to engage the turnbuckle for adjustment in a second adjusting position, wherein the elongated cover member covers substantially all of the turnbuckle body in the first stowed position and is configured to cover the two turnbuckle eyes when it is in the first stowed position.

2. The bulldozer blade pitch adjuster of claim 1, wherein the elongated cover member covers the top surface and two opposing sides of the turnbuckle body and the turnbuckle eyes in the stowed position.

3. The bulldozer blade pitch adjuster of claim 2, wherein the turnbuckle body defines a first pair of opposed wrenching flats spaced a first distance apart, and the elongated cover member has a pair of longitudinally extending portions spaced the first distance apart to engage the first pair of wrenching flats when the elongated cover member is in the second adjusting position.

4. The bulldozer blade pitch adjuster of claim 3 wherein the turnbuckle body defines a second pair of wrenching flats spaced the first distance apart, the second pair being spaced angularly away from the first pair to provide another pair of surfaces engageable by the elongated cover member.

5. The bulldozer blade adjuster of claim 4 wherein the elongated member is configured as an elongated U-channel including two elongate and parallel sidewalls and an elongated central bridging region extending between and coupling the two sidewalls, and further wherein the central region is cut away at one end to form the pair of longitudinally extending portions.

6. The adjuster of claim 5, further comprising securing means for securing the cover member to the turnbuckle body.

7. A bulldozer blade pitch adjuster, comprising:

an adjustable length member having a body and first and second members engaged to the body, the first and second members extending from the body an adjustable length; and a cover configured to be removeably fixed to the adjustable length member in a first covering position and to engage the adjustable length member for adjustment in a second adjusting position, wherein the cover covers, in the first covering position, (i) the first and second members and (ii) a top surface and two opposing sides of the body, the body defining first wrenching flats spaced a first distance apart, and the cover having a pair of longitudinally extending portions spaced the first distance apart to engage the first wrenching flats when the cover is in the second adjusting position, the body defining second wrenching flats spaced the first distance apart, the second flats being spaced angularly away from the first flats, and the cover being configured as an elongated U-channel including two elongate and parallel sidewalls and an elongated central bridging region extending between and coupling the two sidewalls, and further wherein the central region is cut away at one end to form the pair of longitudinally extending portions.

8. The adjuster of claim 7 further comprising securing means for securing the cover to the adjustable length member.

9. The adjuster of claim 8, wherein the securing means includes an elongated pin.

10. The adjuster of claim 9, wherein the securing means includes a key that is insertable into the elongated pin to secure the pin to the body.

11. A bulldozer blade pitch adjuster, comprising:

a turnbuckle having first and second turnbuckle eyes and a turnbuckle body joining the turnbuckle eyes; and an elongated cover member configured to be removeably fixed to the turnbuckle in a first stowed position and to engage the turnbuckle for adjustment in a second adjusting position, wherein the elongated cover is configured to cover the two turnbuckle eyes when it is in the first stowed position.

* * * * *